US005823264A

United States Patent [19]

Ringgenberg

[11] Patent Number: 5,823,264

[45] Date of Patent: Oct. 20, 1998

[54] TRAVEL JOINT FOR USE IN A SUBTERRANEAN WELL

[75] Inventor: Paul D. Ringgenberg, Carrollton, Tex.

[73] Assignee: Halliburton Energy Services, inc., Dallas, Tex.

[21] Appl. No.: 642,733

[22] Filed: May 3, 1996

[51] Int. Cl.[6] ..... E21B 17/07

[52] U.S. Cl. ..... 166/355; 166/367; 175/324; 285/302

[58] Field of Search ..... 166/242.7, 355, 166/367; 175/321; 285/165, 302, 913

[56] References Cited

U.S. PATENT DOCUMENTS

| | | | |
|---|---|---|---|
| 4,433,725 | 2/1984 | Bowyer | 285/302 X |
| 4,693,316 | 9/1987 | Ringgenberg et al. | 166/355 |
| 4,821,818 | 4/1989 | Metferd | 285/913 X |
| 5,160,174 | 11/1992 | Thompson | 285/302 X |
| 5,168,944 | 12/1992 | Andersson | 285/302 X |
| 5,431,507 | 7/1995 | Smilanick | 285/913 |

OTHER PUBLICATIONS

Round Mandrel Slip Joint
Halliburton Energy Services Technical Data Sheet; 1994; two pages Slip Joint.

Halliburton Services customer manual; not dated; three pages GP (Gravel Pack) Slip Joint.

Halliburton Energy Services Technical Data Sheet, undated, pp. 5–1 through 5–7 PCT System—Full Bore.

Schlumberger Technical Data Sheet; Jan. 1987; pp. 159–159.

*Primary Examiner*—William P Neuder
*Attorney, Agent, or Firm*—Wiliam M. Imwalle; Paul I. Herman; Marlin R. Smith

[57] ABSTRACT

A travel joint provides economical manufacture, installation, service, and operation thereof. The travel joint substantially reduces the number of parts potentially exposed to corrosive fluid, eliminates cavities wherein such corrosive fluid may become trapped, and substantially reduces the number of dynamic and static seals required for its operation. Additionally, a torque transmitting member is utilized to prevent torquing through threaded service breaks in the travel joint. In a preferred embodiment, a travel joint has a tubular upper case, a torque collar rotationally and axially coupled to the upper case, a tubular mandrel axially slidably received in the upper case and torque collar, and rotationally coupled to the torque collar, and an adapter which axially and radially inwardly retains the torque collar.

33 Claims, 9 Drawing Sheets

100
140
130
146
144
102

100
104
130
146
144
106

100
108
198
130
146
110

100
112
146
130
198
132
194
190
150
188
188
192
186
168
148
188
176
174
178
4
4
174
136
170
134
158
172
138
198
182
160
184
202
114
116
136
138
182
134
100
192
198
132
160
118
120
100
192
132
198
160
122

FIG.6D
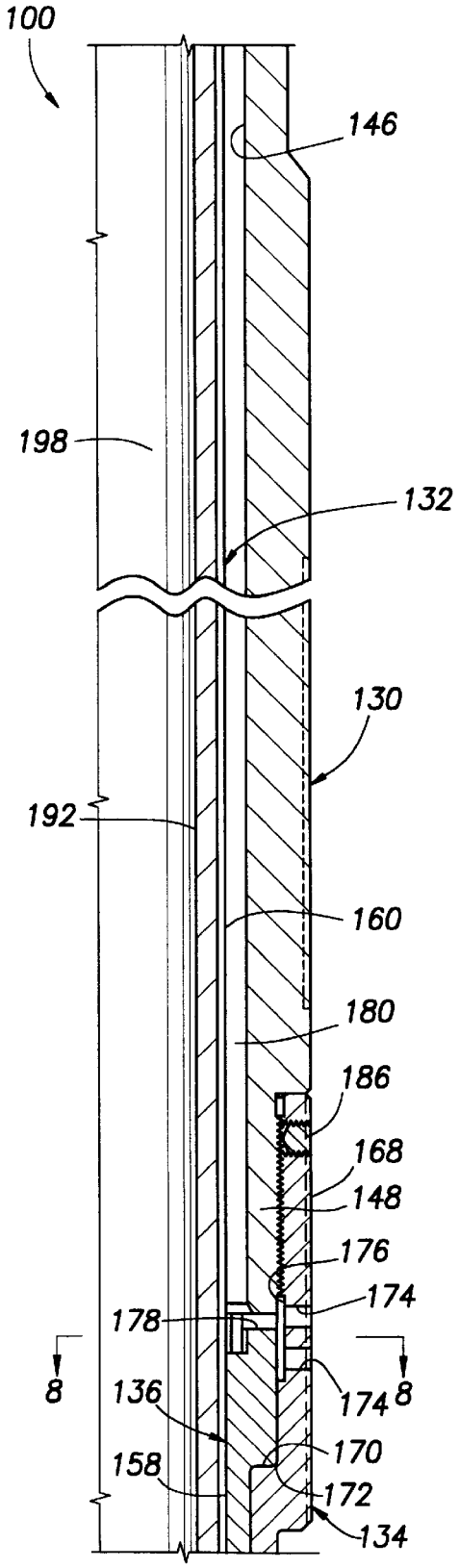
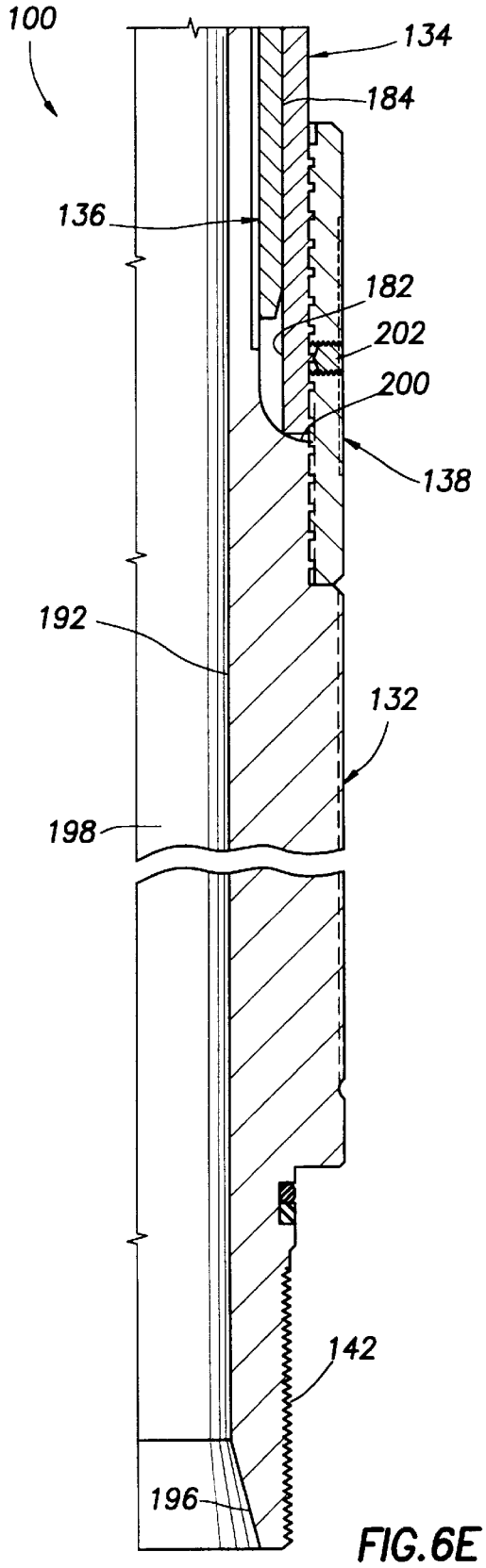
FIG.6E

TRAVEL JOINT FOR USE IN A SUBTERRANEAN WELL

BACKGROUND OF THE INVENTION

The present invention relates generally to tools utilized in subterranean wells and, in a preferred embodiment thereof, more particularly provides a travel joint.

Travel joints and slip joints are well known in the art of drilling and completing subterranean wells. Simply stated, travel and slip joints provide a limited range of axial displacement of a portion of a tool string connected below the travel or slip joint relative to a portion of the tool string connected above the travel or slip joint. In this manner, a travel or slip joint may provide axial travel needed to set a packer within the well, compensate for expansion and contraction of the tool string, compensate for movement of a water-borne vessel, and provide other useful functions.

In the common terminology of the art, and as used hereinbelow, a travel joint is typically distinguished from a slip joint in that a slip joint is volume balanced, whereas a travel joint is not volume balanced. Since each is essentially a generally tubular telescoping assembly, it may be readily seen that, if volume balancing is not provided, axial expansion of the assembly will result in a corresponding effective decrease in a level of fluid in the assembly. Conversely, and again without volume balancing, axial contraction of the assembly will result in a corresponding effective increase in the level of fluid in the assembly.

A further distinction between travel and slip joints is made according to whether torque may be transmitted through the joint. In some wellsite operations, it is desirable to transmit torque through a tool string to, for example, set a packer, operate other tools in the tool string, rotate a drill bit, etc. An example of a slip joint which is capable of transmitting torque may be found in U.S. Pat. No. 4,693,316 assigned to the assignee of the present invention, the disclosure of which is incorporated herein by reference. An example of a travel joint which is capable of transmitting torque may be found in the Bumper Sub, Part No. 628.0301, marketed by Halliburton Energy Services, Inc.

A disadvantage of typical travel and slip joint designs is that, when they are utilized in wellsite operations wherein corrosive fluid, such as acid, is pumped through them, no provision is made for flushing or wiping internal cavities and surfaces exposed to the corrosive fluid. Therefore, even if the corrosive fluid is no longer being pumped through them, some of the corrosive fluid remains in the internal cavities and on the internal surfaces. In particular, slip joints with their volume balancing tend to have a large number of internal cavities and surfaces which are vulnerable to corrosive fluids.

In order to protect typical travel and slip joints from such corrosive fluid introduced therein, it has been common practice to manufacture all parts of the travel and slip joints, which may be exposed to the corrosive fluid, from corrosion resistant alloys, such as Inconel. This, however, is an expensive proposition given the high cost of corrosion resistant alloys, the large number of parts in a typical travel or slip joint which may be exposed to the corrosive fluid, and the typical extended lengths of such parts.

Another disadvantage of typical travel and slip joint designs is that they contain no provision for substantially completely wiping internal surfaces exposed to corrosive fluid. Where, for example, acid is pumped through a tool string, it is common practice for acid inhibitors to be mixed with the acid to prevent corrosion of metals exposed thereto for a period of approximately twelve to sixteen hours. If internal surfaces exposed to the acid could be substantially completely wiped or effectively flushed after such exposure and while the acid inhibitors are still effective, corrosion of the internal surfaces could be greatly reduced, thereby extending the useful life of the travel or slip joint.

A further disadvantage of typical travel and slip joint designs is that a multiplicity of internal bores are combined to make up axial flow passages therethrough. Due to machining tolerances, it is common for the internal bores to be nonconcentric. These misaligned internal bores restrict fluid flow therethrough, hinder the passage of other tools, such as wireline tools, through the axial passages, make it difficult to adequately flush corrosive fluid from the axial passages, and generally increase the cost to manufacture and service the tools.

Where abrupt shoulders are formed between adjacent internal bores, or are otherwise formed in the axial flow passage of a travel or slip joint, the above-listed problems are exacerbated. Additionally, at high flow rates, material surrounding the axial flow passage may be quickly eroded or "washed out". Thus, for these reasons and others, a smooth unbroken axial flow passage having few constituent parts is preferred in a travel or slip joint.

A still further disadvantage of a typical travel or slip joint which is capable of transmitting torque, is that the mechanism utilized to transmit torque contributes greatly to the length of the travel or slip joint, presents difficult sealing problems, requires time-consuming, difficult, and expensive machining operations, and/or increases dramatically the number of internal surfaces which may be exposed to corrosive fluid. In particular, most common slip joints include axial sections which function almost exclusively for transmitting torque from one telescoping member to another, which are axially separated from volume balancing sections of the slip joints, and which have surfaces and cavities that are exposed to fluid flowing through the slip joints.

Typical travel and slip joints which are capable of transmitting torque also include threaded connections that must be unthreaded in order to service the tools. Unfortunately, such threaded connections are also utilized to transmit torque in typical travel and slip joints. This situation makes the tools difficult or impossible to service at a wellsite. Usually, when high torque loads have been transmitted through the threaded connections, the travel and slip joints must be transported to a shop where specialized equipment is available to loosen the connections.

From the foregoing, it can be seen that it would be quite desirable to provide a travel joint which does not include pockets and cavities wherein fluid, such as acid, may be trapped, which does not include a large number of parts that must be made of corrosion resistant materials where corrosion resistance is desired, which does not have excessive length, which includes no service breaks or other threaded connections which are tightened or untightened when torque is transmitted therethrough, which does not have multiple threaded connections that must be disconnected for service thereof, and which does not have abrupt internal shoulders and flow restrictions, but which is capable of transmitting torque, requires only one dynamic seal, includes only one minimum internal diameter part, and which is economical to manufacture, install, service, and operate. It is accordingly an object of the present invention to provide such a travel joint.

SUMMARY OF THE INVENTION

In carrying out the principles of the present invention, in accordance with an embodiment thereof, a travel joint is provided which is a generally tubular telescoping device capable of transmitting torque, which is economical to manufacture, install, service, and operate, and which is particularly well suited for operations in a subterranean well wherein corrosive or other potentially harmful fluids are flowed through the travel joint.

In broad terms, an axially telescoping and generally tubular tool is provided for use in a subterranean well wherein a torque is to be applied to the tool. In one aspect of the present invention, torque is transmitted through the tool via complementarily shaped axial projections. The tool includes a housing, a mandrel, and a collar.

The housing is tubular and elongated and has opposite ends. One of the housing opposite ends has a circumferentially spaced apart series of axially extending first projections formed thereon. The mandrel is tubular and is axially and telescopingly received in the housing.

The collar is tubular and elongated and has opposite ends. One of the collar opposite ends has a circumferentially spaced apart series of axially extending second projections formed thereon. The second projections are complementarily shaped relative to the first projections, and the second projections cooperatively circumferentially engage the first projections. Torque may be transmitted from the housing to the collar by the cooperative engagement of the first and second projections.

Also provided is a travel joint for use in a subterranean well. In another aspect of the present invention, the travel joint includes parts with complementarily shaped profiles, the profiles permitting axial displacement of one part relative to the other, but preventing rotational displacement of the parts relative to each other. The travel joint includes a housing, a torque collar, and a mandrel.

The housing is generally tubular and has opposite ends. The torque collar is also generally tubular, is releasably attached to the housing, and extends axially outwardly therefrom. The torque collar includes an inner side surface and a first axially extending profile formed on the inner side surface.

The mandrel is generally tubular and is axially and slidably received in the torque collar. The mandrel includes an outer side surface and a second axially extending profile formed on the outer side surface. The second profile is complementarily shaped relative to the first profile, and the second profile cooperatively engages the first profile. The mandrel is, thereby, restricted from rotational displacement relative to the torque collar and is permitted to displace axially relative to the torque collar.

In yet another aspect of the present invention, apparatus for use in a subterranean well is also provided, which apparatus includes a torque transmitting member that is axially split. The apparatus includes a housing, mandrel, collar, and an adapter.

The housing is tubular and has opposite ends. One of the housing opposite ends has a circumferentially disposed first configuration formed thereon. The mandrel is tubular and is telescopingly received in the housing. A portion of the mandrel extends axially outwardly from the housing end having the first configuration formed thereon.

The collar is tubular and is axially and slidingly disposed on the mandrel portion. The collar includes an outer side surface and opposite ends. One of the collar opposite ends has a circumferentially disposed second configuration formed thereon which is complementarily shaped relative to the first configuration.

The adapter is tubular and has opposite ends. It is radially outwardly disposed relative to the collar outer side surface. One of the adapter opposite ends is attached to the housing opposite end having the first configuration formed thereon. The adapter radially inwardly retains the collar, and axially retains the first configuration in cooperative engagement with the second configuration.

In a subterranean well having an elongated tool string axially disposed therein, a tool is also provided for transmitting torque within the tool string. In a still further aspect of the present invention, a torque transmitting member is divided circumferentially and aligned by means of a circumferentially extending parting line. The tool includes a mandrel and a collar.

The mandrel is tubular and has an axially extending outer side surface formed thereon. The mandrel is couplable to the tool string.

The collar is axially slidably disposed on the mandrel and circumscribes the mandrel outer side surface. The collar has an inner side surface which axially slidably engages the mandrel outer side surface. The collar inner side surface cooperatively engages the mandrel outer side surface such that the collar is prevented from rotating on the mandrel.

The collar is circumferentially divided by an axially extending parting line which permits the collar to be radially outwardly expanded relative to the mandrel outer side surface. The parting line has a portion thereof which extends at least partially circumferentially about the collar, such that when the collar is operatively disposed on the mandrel the parting line portion axially aligns the collar on opposite sides of the parting line.

An axially compressible joint for use in a tool string within a subterranean well is provided as well. The joint has provision therein for fluid communication when the joint is axially compressed. The joint includes an outer housing, a mandrel, a seal and a collar.

The outer housing is tubular. It has an axially extending bore formed therethrough and opposite ends. The mandrel is telescopingly received in the outer housing bore. The mandrel has a radially enlarged portion and a radially reduced portion. The radially enlarged portion axially slidingly engages the outer housing bore, and the radially reduced portion extends axially outwardly from one of the outer housing opposite ends.

The seal is disposed on the inner housing radially enlarged portion. It sealingly engages the radially enlarged portion of the mandrel, and sealingly and slidingly engages the outer housing bore.

The collar is tubular and is axially slidingly disposed on the inner housing radially reduced portion. The collar is coupled to the outer housing. A radially extending fluid passage is formed on the collar.

The outer housing, mandrel, and collar define an annular chamber having a variable volume therebetween. The annular chamber is disposed radially intermediate the outer housing bore and the mandrel radially reduced portion, and is disposed axially intermediate the mandrel radially enlarged portion and the collar. The annular chamber is in fluid communication with the collar fluid passage.

In a still further aspect of the present invention, a travel joint operatively positionable within a tool string in a subterranean wellbore is provided. An internal surface of the travel joint is capable of being conveniently wiped during operation of the travel joint. The travel joint includes an outer housing, a mandrel, and a seal.

The outer housing is tubular and has an axially extending inner side surface defining an axial flow passage therethrough. The outer housing is directly couplable to the tool string.

The mandrel is tubular and has first and second axial portions. The mandrel first axial portion is axially slidably received in the flow passage. The mandrel second axial portion extends axially outwardly from the outer housing and is directly couplable to the tool string. The mandrel is axially reciprocable within the outer housing bore.

The seal is carried on the mandrel first axial portion and radially outwardly engages the outer housing bore. The seal is capable of traversing substantially all of the outer housing bore when the mandrel is axially reciprocated within the outer housing bore.

The use of the disclosed travel joint improves wellsite operations wherein axially reciprocal tool strings are required. In particular, where corrosive fluid is flowed through such a tool string, the disclosed travel joint beneficially enhances the functional and economics aspects of the operation.

BRIEF DESCRIPTION OF THE DRAWINGS

FIGS. 6A–6E are quarter-sectional views of successive axial portions of the travel joint shown in FIGS. 3A–3H, the travel joint being disposed in a fully retracted configuration thereof;

DETAILED DESCRIPTION

Figure 1A:
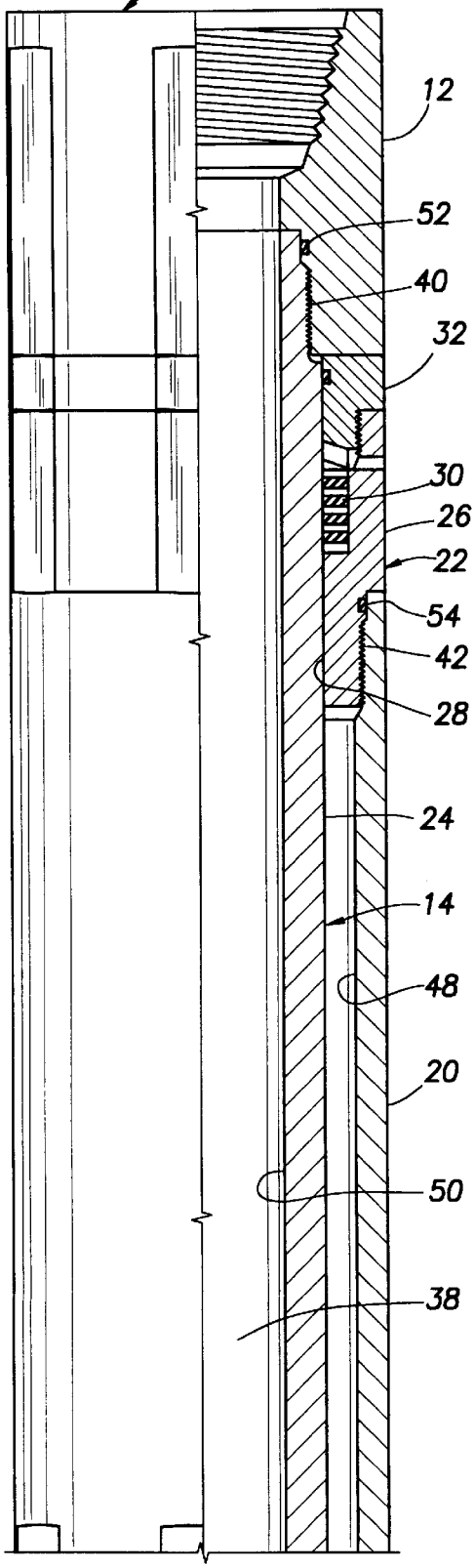
FIG. 1A (PRIOR ART)
FIGS. 1A & 1B (Prior Art) are quarter-sectional views of successive axial sections of a prior art travel joint.
Figure 1B:
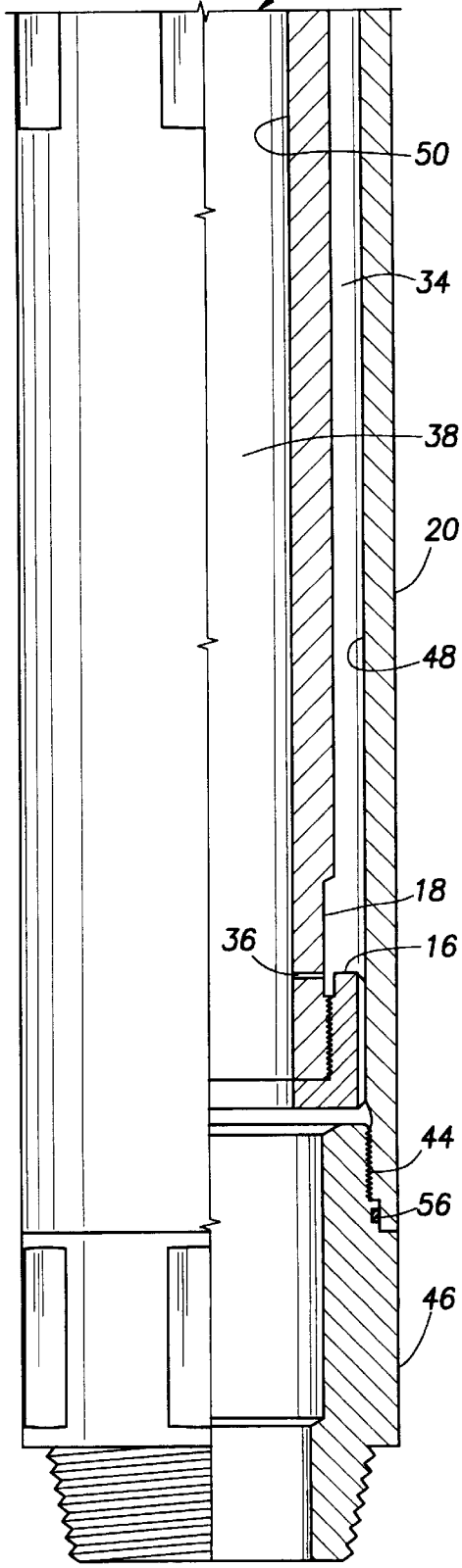
FIG. 1B (PRIOR ART)

Illustrated in FIGS. 1A & 1B (Prior Art) are successive axial sections of a travel joint 10. An upper adapter 12 is sealingly and threadedly connected to an axially extending tubular inner mandrel 14. A collar 16 is threadedly attached to a lower end portion 18 of the mandrel 14. The collar 16 centers the mandrel 14 somewhat within a tubular outer housing 20, and prevents removal of the mandrel 14 from within a seal sub 22.

The mandrel 14 has a hexagonal outer side surface 24 formed thereon. A seal housing portion 26 of the seal sub 22 has an axially extending hexagonal inner side surface 28 formed thereon which complementarily and slidingly receives the hexagonal outer side surface 24 therein. Packing 30, disposed radially intermediate the seal housing 26 and the inner mandrel 14, conforms to the hexagonal outer surface 24 for sealing engagement therewith. A retainer 32 secures the packing 30 axially within the seal housing 26. A disadvantage of such hexagonal packing 30 is that it is notoriously leak-prone.

As the inner mandrel 14 is axially displaced, along with the upper adapter 12 and collar 16, relative to the outer housing 20, packing 30 sealingly and slidingly engages the surface 24, and the seal housing 26 inner surface 28 complementarily and slidingly engages the surface 24. An annular chamber 34 formed radially intermediate the mandrel 14 and outer housing 20 is permitted to axially expand or contract as a result of such axial displacement, and fluid communication between the annular chamber and an interior axially extending flow passage 38 of the travel joint 10 is provided by a radially extending port 36 formed through the mandrel lower end 18.

It will be readily apparent to one having an ordinary level of skill in the art that, if a corrosive or otherwise potentially harmful liquid, such as acid, is introduced into the flow passage 38 of the travel joint 10, it may easily enter the annular chamber 34. Long term exposure of the travel joint 10 to such harmful liquid may cause a decrease in strength, a decrease in toughness, pitting on sealing surfaces, such as hexagonal surface 24, etc. It will also be readily apparent to one of ordinary skill in the art that, once a harmful liquid, such as acid, enters the annular chamber 34, it will remain in the annular chamber until the annular chamber is adequately flushed by, for example, introducing another liquid into the interior flow passage 38 of the travel joint 10 and repeatedly stroking the mandrel 14 into and out of the housing 20. It is well known that typical acid inhibitors utilized in downhole operations, such as formation stimulation, have an effective life of only about 12 to 16 hours—thereafter the acid is free to attack any unprotected metal.

Note that if torque is applied to the upper adaptor 12 to, for example, set a packer below the travel joint 10, that torque will also be applied through several service breaks, namely, threaded connection 40 between the upper adaptor 12 and the mandrel 14, threaded connection 42 between the seal sub 22 and the outer housing 20, and threaded connection 44 between the outer housing and a lower adapter 46. Each of these threaded connections 40, 42, 44 must be untightened when the travel joint 10 is serviced. As high torque loads must often be applied through travel joints in wellbore operations, such torquing through of service breaks makes servicing the travel joint 10 very difficult. The large number of service breaks makes servicing the travel joint 10 tedious and time-consuming. Additionally, no less than three static seals 52, 54, 56 are required on the travel joint 10.

Even if the travel joint 10 is axially stroked after a corrosive fluid, such as acid, is flowed therethrough, several large surfaces are not wiped clean by such stroking. For example, internal surface 48 of the outer housing 20 is not wiped by the packing 30 when the travel joint 10 is stroked. As further examples, internal surface 50 of the mandrel 14 and lower end 18 of the mandrel are not wiped when the travel joint 10 is stroked. Thus, these surfaces and others are not cleaned of the corrosive fluid by stroking of the travel joint 10.

In order for the travel joint 10 to be made corrosion resistant, many of its parts must be manufactured of expensive corrosion resistant alloys, such as Inconel. No less than six parts—the upper adapter 12, mandrel 14, seal sub 22, outer housing 20, collar 16, and lower adapter 46—will potentially be exposed to corrosive fluid. Therefore, substantially all of the travel joint 10 must be made of expensive corrosion resistant alloys if it is to be utilized in a corrosive environment.

The travel joint 10 has four parts—the upper adapter 12, mandrel 14, collar 16, and lower adapter 46—which combinatively form the inner flow passage 38. Due to the necessity of machining tolerances in the manufacture of these parts, such as inner diameter, thread form, and concentricity tolerances, passage of tools, such as wireline logging tools, or the flow of fluids through the inner flow passage 38 may be hindered when such tolerances stack up to cause misalignment between parts, etc. Also, due to the number of interfaces between these parts, washout at high flow rates and pressure drop through the travel joint 10 is increased.

Figure 2A:
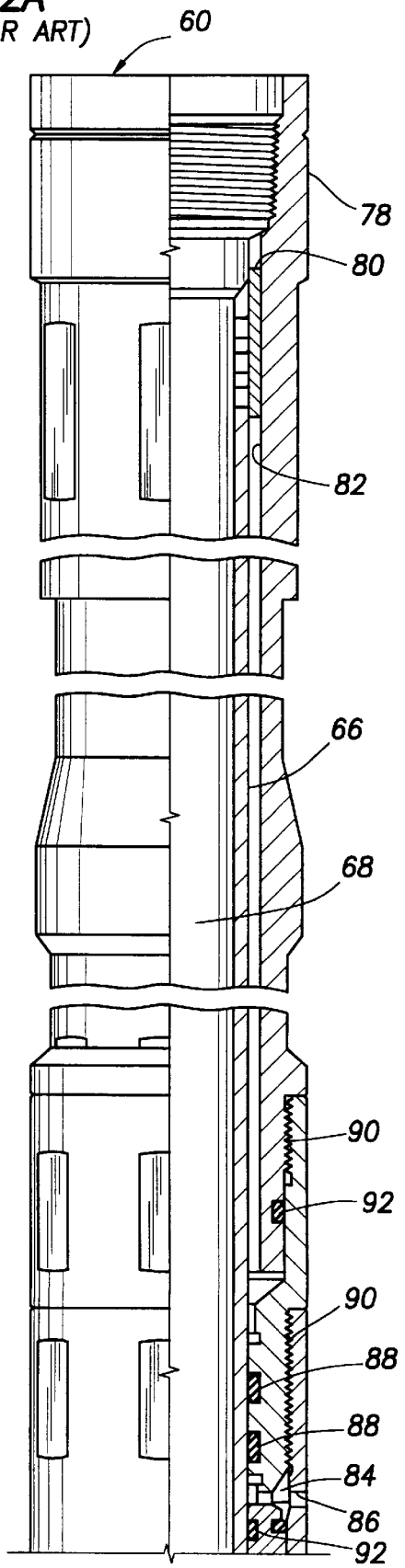
FIG.2A (PRIOR ART)
FIGS. 2A & 2B (Prior Art) are quarter-sectional views of successive axial sections of a prior art slip joint.
Figure 2B:
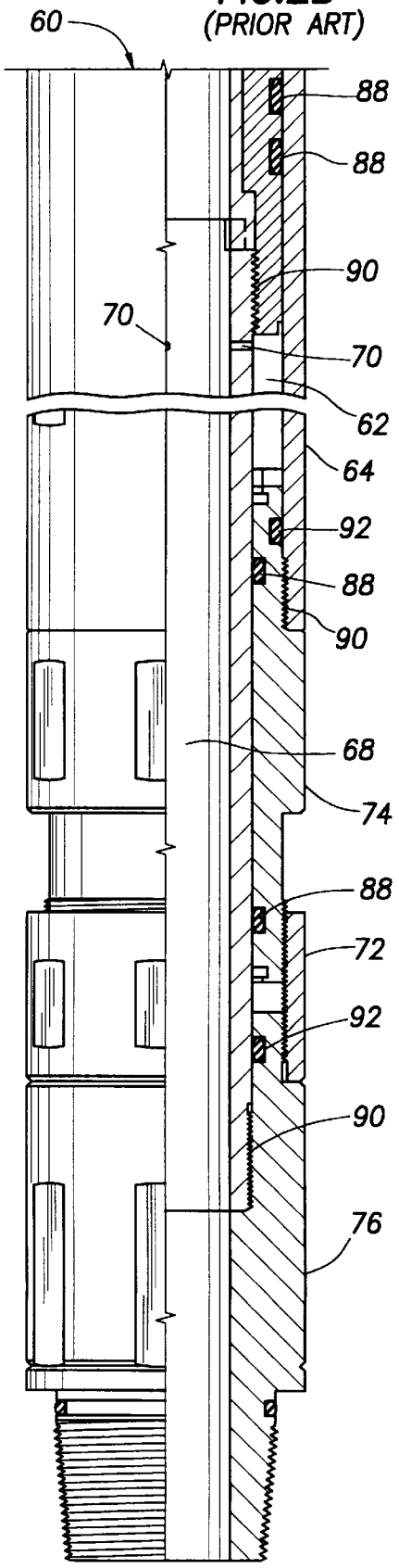
FIG.2B (PRIOR ART)

Turning now to FIGS. 2A & 2B (Prior Art), a slip joint 60 is illustrated in successive axial sections. Slip joint 60 is of the type which is volume balanced, that is, no net increase or decrease in internal fluid volume is experienced when the slip joint is alternately extended and compressed. A fluid chamber 62 formed radially intermediate an outer housing 64 and an inner mandrel 66, the inner mandrel comprising a plurality of axial sections, is axially compressed when the slip joint 60 is extended, and extended when the slip joint is compressed, thereby alternately supplying fluid to, and receiving fluid from, an axial flow passage 68 via ports 70. Conversely, a fluid chamber 84, also formed radially intermediate the outer housing 64 and the inner mandrel 66, is axially extended when the slip joint 60 is extended, and compressed when the slip joint is compressed, thereby alternately receiving fluid from, and supplying fluid to, the exterior of the slip joint 60 via ports 86.

The slip joint 60 is shown in its axially compressed configuration, with a threaded collar 72 preventing axial displacement of a lower sub 74 relative to a lower adapter 76. In service, the threaded collar 72 is unthreaded from the lower adapter 76, thereby permitting the lower adapter 76 and mandrel 66 to axially displace relative to the lower sub 74 and outer housing 64.

The mandrel 66 is keyed to an upper sub 78. A key 80 is axially slidably disposed within a keyway 82 internally formed on the upper sub 78. The key 80 and keyway 82 prevent axial rotation of the mandrel 66 within the slip joint 60.

When corrosive fluids, such as acids, are flowed through the flow passage 68, the fluids may become trapped in the keyway 82 and fluid chamber 62, each of which may not subsequently be flushed with noncorrosive fluid. Additionally, surfaces exposed to corrosive fluid in the keyway 82 and fluid chamber 62 are not subsequently wiped clean by compression or extension of the slip joint 60. In order for the slip joint 60 to operationally survive in a corrosive environment, no less than eight major structural parts of the slip joint must be manufactured of an expensive corrosion resistant alloy, such as Inconel.

As with the travel joint 10 (see FIGS. 1A & 1B), the slip joint 60 has a multiplicity of internal parts and internal shoulders therebetween, which hinder the passage of tools and fluids therethrough, and which cause undesirable pressure drops and washouts at relatively high flow rates of fluid therethrough. Also, as with the travel joint 10, the slip joint 60 has a multiplicity of service breaks 90 and seals 92 associated therewith which make servicing the slip joint relatively expensive, difficult, and time-consuming.

Due to the multiple fluid chambers 84, 62, the slip joint 60 requires a large number of dynamic seals 88—six in the illustrated embodiment. Additionally, the multiple fluid chambers 84, 62 and keyway 82 combine to produce an exceedingly long slip joint assembly 60.

Illustrated in FIGS. 3A–3H is a travel joint 100 embodying principles of the present invention. The travel joint 100 is shown in an extended configuration in which the travel joint is run into a subterranean well. In the following detailed description of the embodiment of the present invention representatively illustrated in the accompanying figures, directional terms, such as "upper", "lower", "upward", "downward", etc., are used in relation to the illustrated travel joint 100 as it is depicted in the accompanying figures. It is to be understood that the travel joint 100 may be utilized in vertical, horizontal, inverted, or inclined orientations without deviating from the principles of the present invention.

Figures 3A, 3B, 3C:
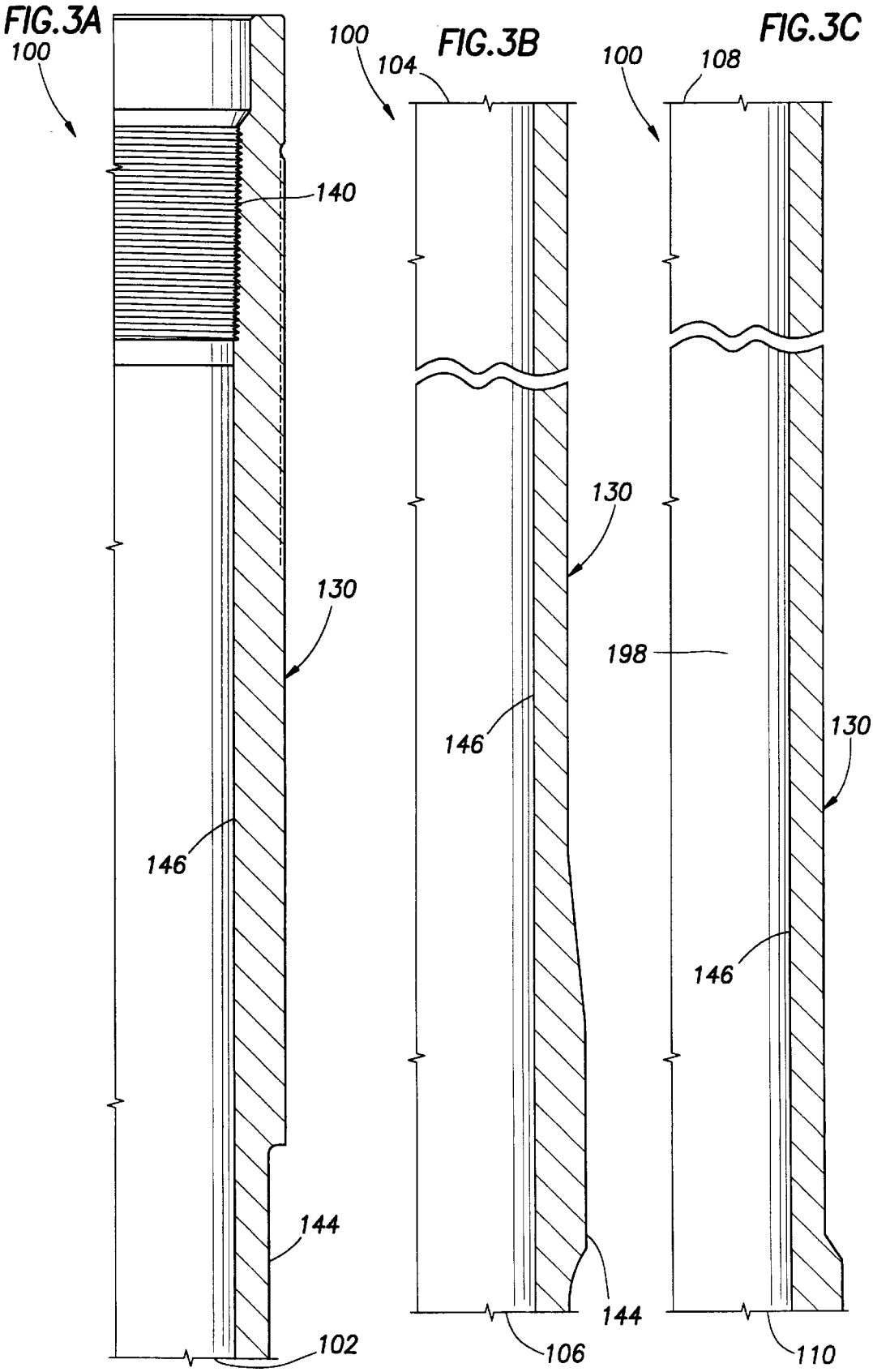
FIGS. 3A–3H are quarter-sectional views of successive axial portions of a travel joint embodying principles of the present invention, the travel joint being disposed in a fully extended configuration thereof.
Figures 3D, 3E, 3F:
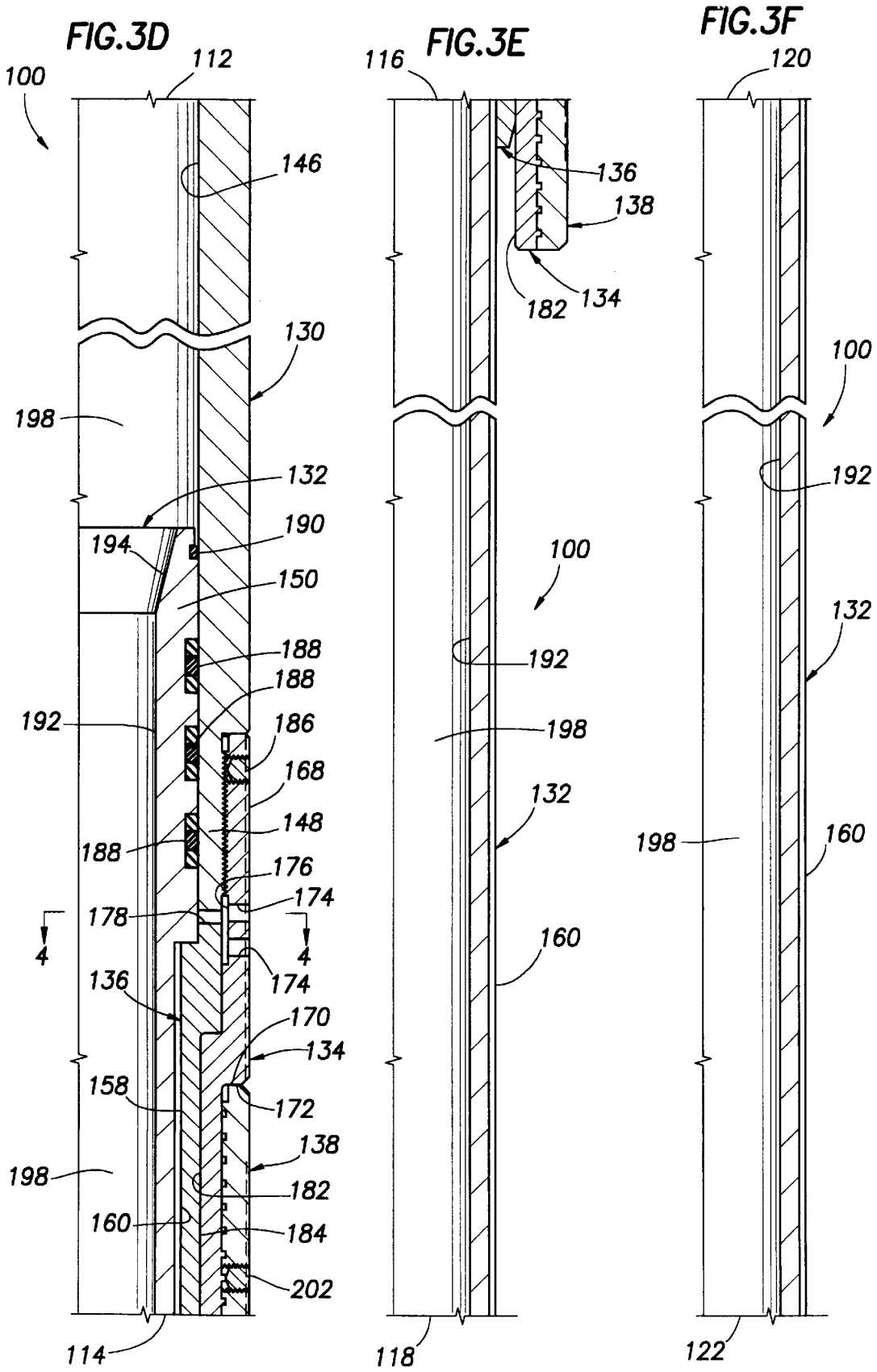
Figure 3G:
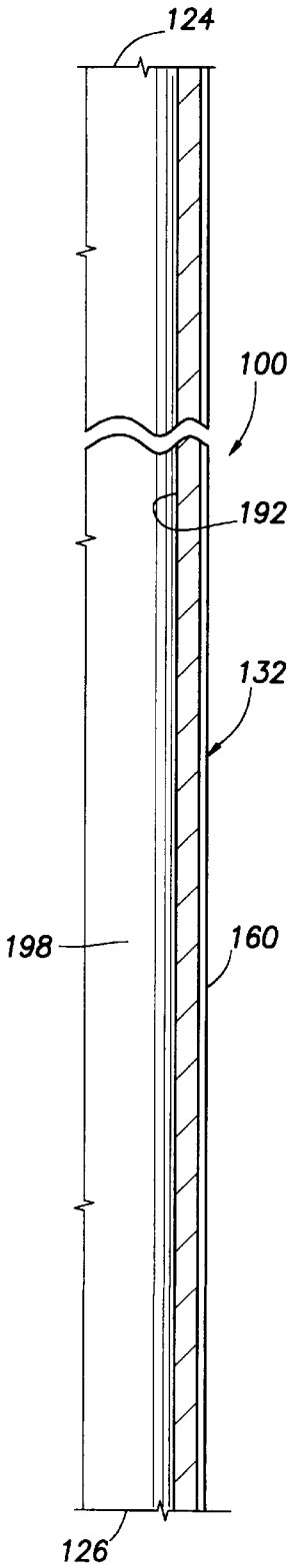
Figure 3H:
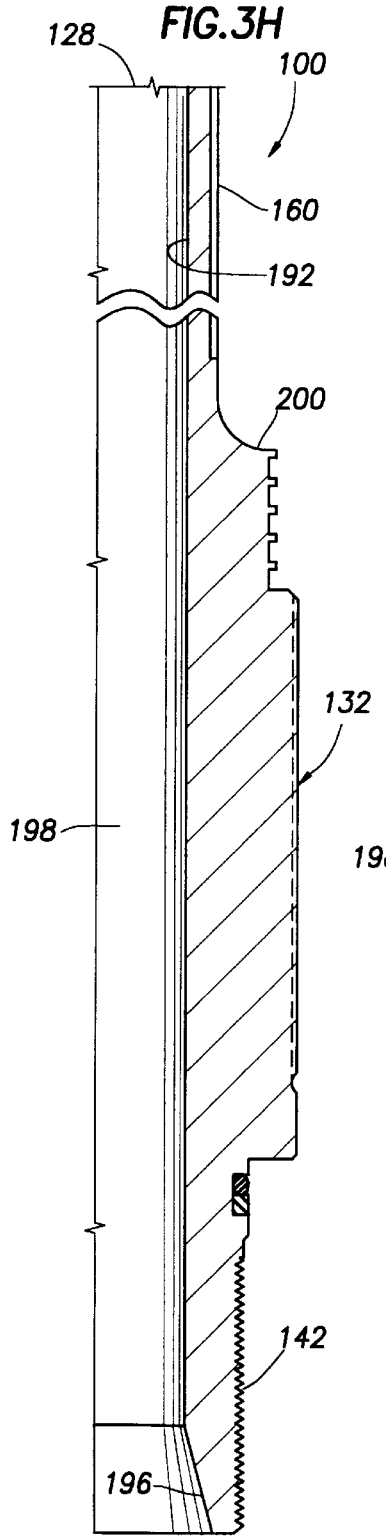

For convenience of illustration, FIGS. 3A–3H show the travel joint 100 in successive axial portions, but it is to be understood that the travel joint is a continuous assembly, lower end 102 of FIG. 3A being continuous with upper end 104 of FIG. 3B, lower end 106 of FIG. 3B being continuous with upper end 108 of FIG. 3C, lower end 110 of FIG. 3C being continuous with upper end 112 of FIG. 3D, lower end 114 of FIG. 3D being continuous with upper end 116 of FIG. 3E, lower end 118 of FIG. 3E being continuous with upper end 120 of FIG. 3F, lower end 122 of FIG. 3F being continuous with upper end 124 of FIG. 3G, and lower end 126 of FIG. 3G being continuous with upper end 128 of FIG. 3H.

The travel joint 100 includes an upper case 130, a mandrel 132, an adapter 134, a torque collar 136, and a locking collar 138, each of which is generally tubular-shaped and extends axially and generally concentrically in relation to the other ones of them. The unique construction and interrelationships of the component parts of the travel joint 100, among other features, enable the travel joint to be inexpensively manufactured, easily serviced, and particularly well suited for operations wherein corrosive fluid, such as acid, may be flowed therethrough. These and other benefits are obtained through utilization of the travel joint 100 of the present invention, and will become apparent upon consideration of the following detailed description.

Upper case 130 has an internally threaded upper portion 140 formed thereon for interconnection with other equipment (not shown), for transport of the travel joint 100 within a wellbore, and for transmitting torque. Similarly, the mandrel 132 has a lower externally threaded portion 142 formed thereon. Upper case 130 also has an external profile 144 formed thereon which conforms to that of a typical drill collar. The external profile 144 thus permits standard elevators and slips to be used when handling the travel joint 100 on a modern rotary rig, as will be readily apparent to one of ordinary skill in the art.

Extending axially downward from the internally threaded upper portion 140 is a smooth and continuous internal bore 146 which extends completely downwardly through a lower externally threaded end 148 of the upper case 130. A radially enlarged upper seal portion 150 of the mandrel 132 is slidingly received in the bore 146 at the lower end 148 with the travel joint 100 in its representatively illustrated expanded configuration. Thus, from the internally threaded upper end 140 to the upper portion 150 of the mandrel 132, no portion of the bore 146 is broken, has a shoulder thereon, has a port formed thereon, has a pocket or chamber in which fluid may be trapped, or is in any other manner discontinuous. As will be more fully appreciated by consideration of the following further description of the travel joint 100, such construction of the travel joint also permits the bore 146 to be substantially completely wiped by the upper portion 150 of the mandrel 132 when the travel joint is stroked to its compressed configuration.

Figure 4:
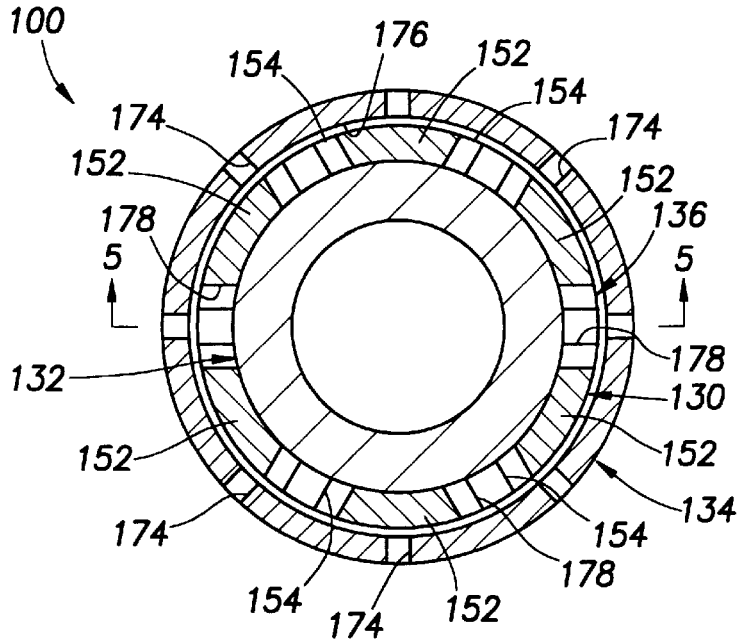
FIG. 4 is a cross-sectional view of the travel joint shown in FIGS. 3A–3H, taken along line 4—4 of FIG. 3D.
Figure 5:
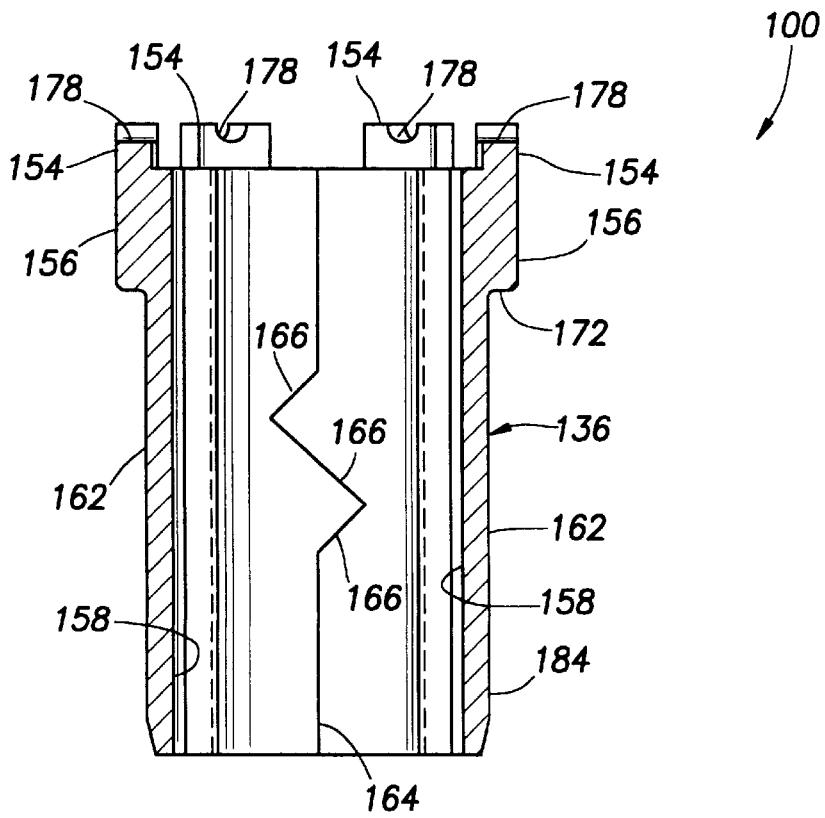
FIG. 5 is a cross-sectional view of a torque collar portion of the travel joint shown in FIGS. 3A–3H, taken along line 5—5 of FIG. 4.

Referring additionally now to FIG. 4, a cross-sectional view is seen, taken along line 4—4 of FIG. 3D. In this view, the manner in which torque is transmitted through the travel joint 100 may be clearly seen. Lower end 148 of the upper case 130 has six downwardly extending and circumferentially spaced apart projections 152 formed thereon. The downwardly extending projections 152 circumferentially engage six complementarily shaped and circumferentially spaced apart upwardly extending projections 154 formed on the torque collar 136. Referring additionally now to FIG. 5, an axially extending cross-sectional view of the torque collar 136 may be seen, taken along line 5—5 of FIG. 4. It may now be fully appreciated that the projections 154 extend axially upward from a radially enlarged upper portion 156 of the torque collar 136.

When torque is applied to the upper portion 140 of the upper case 130, projections 152 transmit the torque to projections 154, and, thence, to the torque collar 136. The torque collar 136, in turn, has a specially designed internal profile 158 which slidingly engages a complementarily shaped external profile 160 formed on the mandrel 132 (see FIG. 3D). Such cooperative engagement of the internal and external profiles 158, 160 permits the torque to be transmitted from the torque collar 136 to the mandrel 132.

Thus, the torque is transmitted through the travel joint 100 from its upper portion 140 to its lower portion 142, via only one intermediate member, the torque collar 136. Note also, that no service breaks or other intermediate threaded members are torqued or otherwise tightened or loosened by such torque transmission through the travel joint 100.

The torque collar 136 is specially designed for ease of installation on the mandrel 132, while maintaining its ability to transmit torque therethrough. Referring specifically now to FIG. 5, it may be seen that the torque collar 136 is initially formed as a unitary structure, and is subsequently split into two lateral halves 162 by separating the torque collar along two parting lines 164 (only one of which may be seen in FIG. 5). Such splitting along parting lines 164 is preferably accomplished by use of conventional wire EDM processes, although other processes may be utilized without departing from the principles of the present invention.

Parting lines 164 permit the torque collar 136 to be separated into its halves 162, installed onto the external profile 160 of the mandrel 132, and then rejoined. Parting lines 164 are substantially linear, but preferably also contain circumferentially extending portions, such as inclined portions 166 which extend both axially and circumferentially, such that when the halves 162 are rejoined on the mandrel external profile 160, the halves are axially coupled. Thus, each of the rejoined halves 162 cannot axially displace relative to the other one of the halves 162, while they are operatively installed on the external profile 160 of the mandrel 132.

It is to be understood that it is not necessary for the torque collar 136 to be split into halves 162 according to the principles of the present invention. The torque collar 136 may be split into thirds, fourths, etc., or may not be split. In the latter case, an unsplit torque collar 136 may pass axially over a radially reduced lower end portion 142 (compared to that representatively illustrated in FIG. 3H) of a travel joint 100 made according to the principles of the present invention, without departing therefrom.

Referring specifically now to FIG. 3D, torque collar 136 is maintained in axial engagement with the upper case 130 by the adapter 134, the projections 152 on the upper case being thereby maintained in circumferential engagement with the projections 154 on the torque collar. Adapter 134 has an internally threaded upper portion 168 which is threadedly attached to the lower portion 148 of the upper case 130. An internal shoulder 170 formed on the adapter 134 upwardly contacts an external shoulder 172 formed on the torque collar 136, thereby preventing axially downward displacement of the torque collar relative to the upper case 130.

Figure 6A:
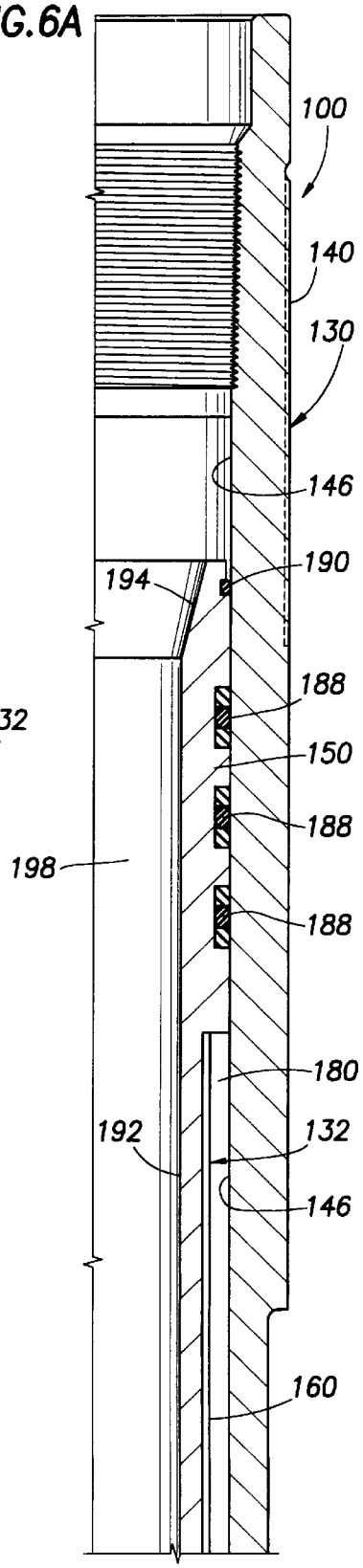

A circumferentially and axially spaced apart series of openings 174 are formed radially through the adapter 134 radially adjacent the projections 152, 154 (see FIGS. 4 & 5). A radially enlarged internal undercut 176 formed on the adapter 134 axially traverses the openings 174 and permits fluid communication between the openings and the projections 152, 154. Projections 154 have semicircular depressions 178 formed thereon (see FIG. 5) to permit fluid communication between the bore 146 and the undercut 176. Thus, as the mandrel 132 is axially displaced relative to the upper case 130, upper portion 150 sliding axially within bore 146, fluid may readily be received in, or expelled from, a cavity 180 (see FIG. 6D) radially intermediate the mandrel 132 and the bore 146, and axially intermediate the upper portion 150 and the torque collar 136, via the depressions 178, undercut 176, and openings 174.

Adapter 134 radially inwardly retains the torque collar 136. In this manner, the torque collar 136 is maintained in operative axially sliding engagement with the mandrel 132. An internal bore 182 formed on the adapter 134 radially inwardly contacts an external diameter 184 formed on the torque collar 136. The torque collar 136 is, thus, prevented from circumferentially displacing relative to the mandrel 132. A retainer, such as set screw 186, prevents axial displacement of the adapter 134 relative to the upper case 130.

The upper portion 150 of the mandrel 132 (see FIG. 6A) has an axially spaced apart series of seals 188 circumferentially disposed thereon. The seals 188 sealingly engage the upper portion 150, and sealingly and slidingly engage the bore 146 of the upper case 130. It is to be understood that such sealing engagement may be provided by any number of such seals 188 without departing from the principles of the present invention, including one, but that the inventor prefers three seals to give a desired level of redundancy.

A wiper ring 190 is also carried on the upper portion 150. The seals 188 and wiper ring 190 permit substantially all of the bore 146 to be cleaned by axial stroking of the mandrel 132 within the upper case 130. Thus, if the bore 146 has been exposed to any corrosive fluid, such as acid, the fluid may be conveniently removed therefrom by axially displacing the mandrel upper portion 150 within the bore 146. It is to be understood that the abovedescribed sealing and wiping functions may be adequately provided by a single seal 188 without departing from the principles of the present invention.

The mandrel 132 has a smooth and continuous bore 192 formed therethrough with radially sloped sections 194, 196 at either end.

In its extended configuration as representatively illustrated in FIGS. 3A–3H, the travel joint 100 thus presents a relatively smooth and unhindered fluid conduit. Fluid may enter the bore 146 of the upper case 130 at its upper portion 140, flow unobstructed axially therethrough, enter the radially sloped section 194, flow unobstructed axially through the bore 192 of the mandrel 132, and flow axially outward through the radially sloped section 196. The travel joint 100 is relatively free of flow restrictions, abrupt shoulders, internally opening cavities, and opportunities for misalignment between component parts, each of which potentially restricts the rate of fluid flow therethrough, invites washouts, and provides opportunity for entrapment of corrosive fluid, among other undesirable characteristics.

Only two parts, the upper case 130 and the mandrel 132, combine to form an axial internal flow passage 198 through the travel joint 100 in the illustrated preferred embodiment. Tolerance stackups, abrupt shoulders, and opportunities for misalignment are thereby minimized in the travel joint 100. Of particular import is the fact that only one part, the mandrel 132, has the minimum bore 192 of the travel joint 100 formed thereon, greatly enhancing the ability to pass tools, such as wireline logging tools, unhindered therethrough.

Turning now to FIGS. 6A–6E, the travel joint 100 is representatively illustrated in an axially compressed configuration thereof. The mandrel 132 has been axially upwardly displaced relative to the upper case 130, a radially extending external shoulder 200 formed on the mandrel 132 (see FIG. 6E) axially contacting the adapter 134. In FIGS. 6A–6E, the manner in which the upper portion 150 of the mandrel 132, and seals 188 and wiper ring 190 carried thereon, substantially completely wipe the bore 146 of the upper case 130 may be clearly seen.

Note that as the travel joint 100 is stroked from its axially extended configuration (see FIGS. 3A–3H) to its axially compressed configuration, no further surfaces of the travel joint are exposed to any fluid which may be contained in the axial flow passage 198. Likewise, when the travel joint 100 is stroked to its axially extended configuration, or any axial position between its extended and compressed configurations, no further surfaces of the travel joint are exposed to any fluid in the flow passage 198. Thus, only the bore 146 of the upper case 130 and the bore 192 of the mandrel 132 are exposed to any fluid in the flow passage 198, and only the upper case 130 and mandrel 132 must be made of a corrosion resistant alloy if corrosive fluid is to be flowed through the flow passage 198. It is to be understood, however, that it is not necessary for upper case 130 and mandrel 132 to be made of a corrosion resistant alloy.

Referring specifically now to FIG. 6E, the travel joint 100 is conveniently maintained in its axially compressed configuration by locking collar 138. During handling prior to being run into a well, after having been run in a well, during makeup onto a tool string on a rotary rig, and other circumstances, it is advantageous for the travel joint 100 to be maintained in its axially compressed configuration. Locking collar 138 may be threaded onto the mandrel 132 to axially interconnect the mandrel and the adapter 134, thereby preventing axial displacement of one relative to the other. A set screw 202 may be utilized to secure the locking collar 138 to the adapter 134 in its position as shown in FIG. 6E, or in its position as shown in FIGS. 3D & 3E.

Figure 6B:
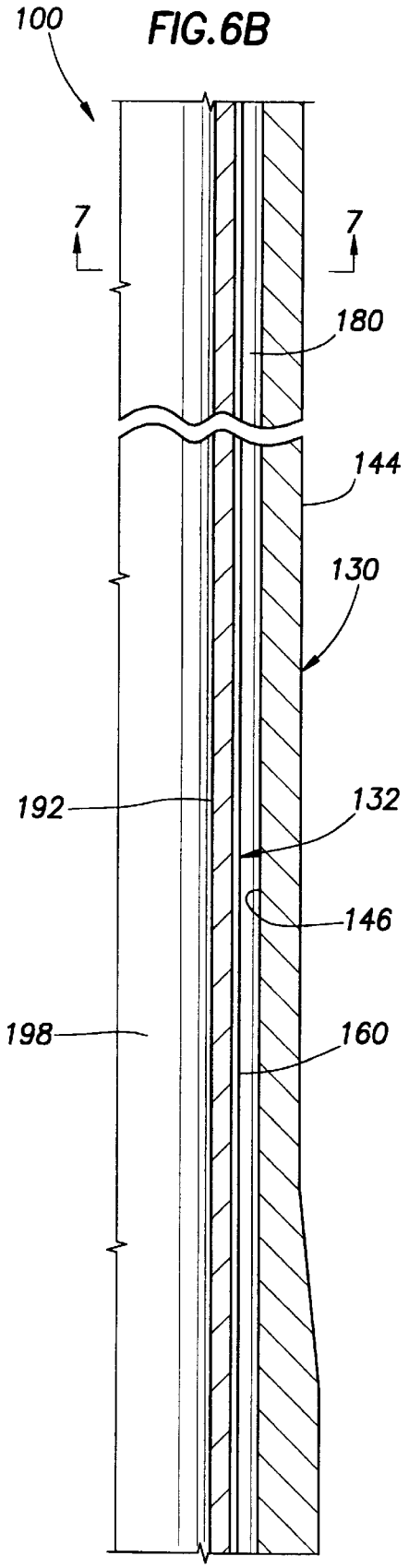
Figure 6C:
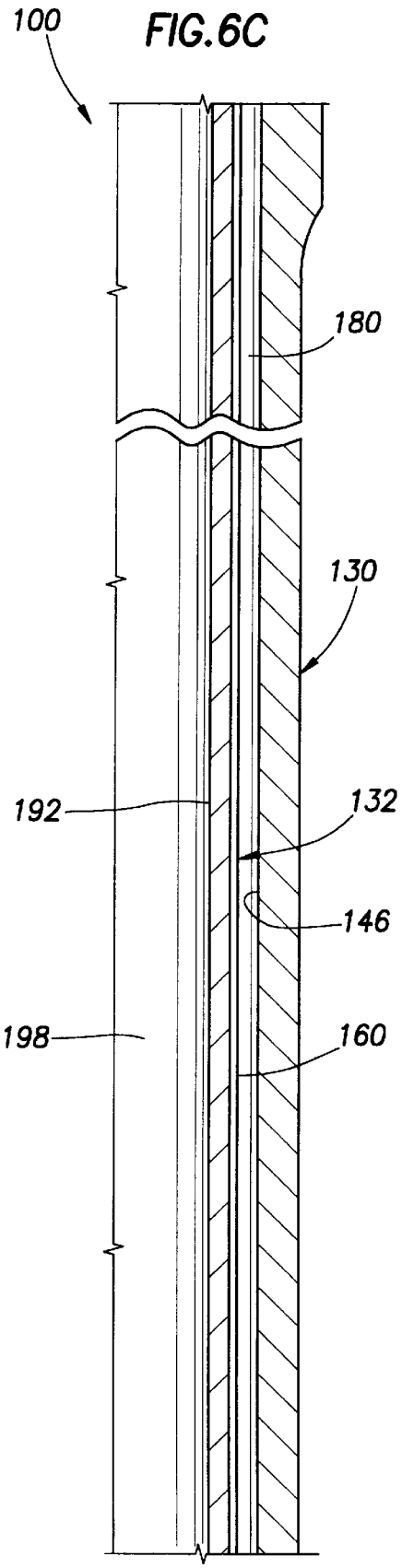
Figure 7:
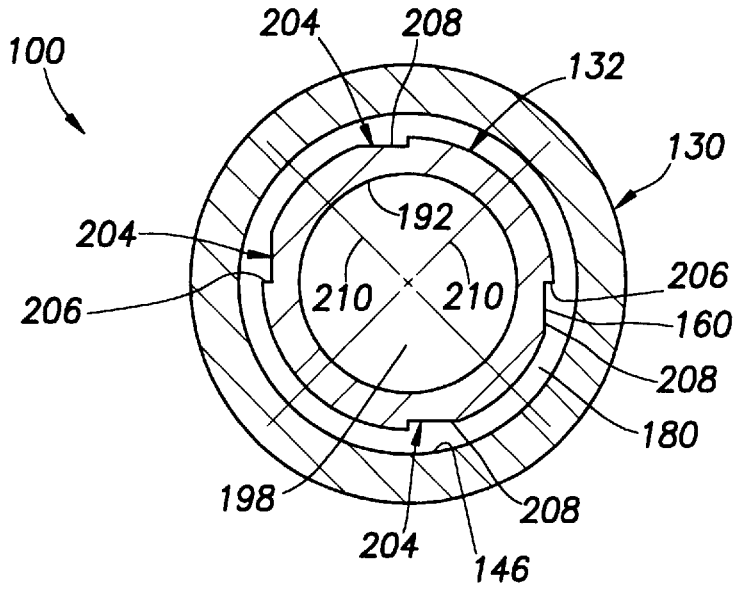
FIG. 7 is a cross-sectional view of the travel joint shown in FIGS. 6A–6E, taken along line 7—7 of FIG. 6B.

Referring additionally now to FIG. 7, a cross-sectional view of the travel joint 100 may be seen, taken along line 7—7 of FIG. 6B. In FIG. 7, the radially spaced apart relationship of the upper case 130 relative to the mandrel 132 may be clearly seen. Cavity 180 is radially intermediate the bore 146 and the external profile 160 of the mandrel 132, as described more fully hereinabove.

In FIG. 7, it may also be clearly seen that the external profile 160 includes a spaced apart series of four axially extending notches 204. Each of the notches 204 has two faces, a radially extending face 206 which is collinear with a radius 210 of the mandrel 132, and a tangentially extending face 208 which is perpendicular to a radius 210 of the mandrel 132. It is to be understood that other, differently configured, notches may be utilized on the profile 160 without departing from the principles of the present invention. For example, a projecting key may be externally formed on the mandrel 132 for sliding engagement with a complementarily shaped keyway formed on the torque sleeve 136, without departing from the principles of the present invention.

Applicant prefers the representatively illustrated profile 160 for its ease of manufacture and minimal reduction in strength of the mandrel 132. If, for example, a typical rectangular keyway were utilized on the profile 160, an end mill, or other machine tool having a width equal to or less than the width of the keyway would have to be used to cut the keyway onto the mandrel 132. Utilizing the representatively illustrated notches 204, however, virtually any width end mill or other machine tool may be used to form the notches. Machining speeds may be substantially increased and machine tool breakage may be substantially decreased by the use of such wider machine tools.

As a further example, if typical rectangular keyways were utilized on the profile 160, the rectangular keyways would have to be cut radially deeper into the mandrel 132 to achieve side faces equivalent in strength to the radial faces 206 of the notches 204. Such radially deeper cutting into the mandrel 132 may substantially reduce the tensile, torsional, bending, burst, and/or collapse strength of the mandrel.

Figure 8:
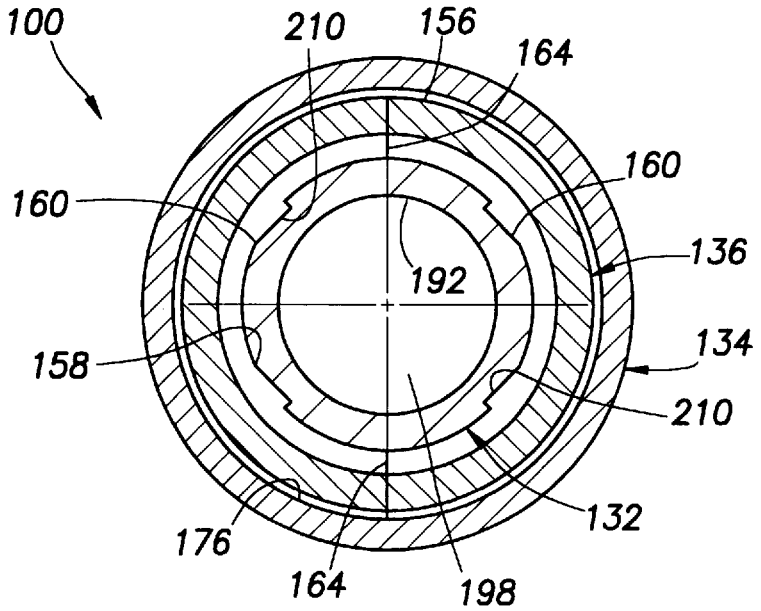
FIG. 8 is a cross-sectional view of the travel joint shown in FIGS. 6A–6E, taken along line 8—8 of FIG. 6D.

Referring additionally now to FIG. 8, a cross-sectional view of the travel joint 100 may be seen, taken along line 8—8 of FIG. 6D. In this view the manner in which the internal profile 158 of the torque collar 136 is complementarily shaped relative to the profile 160 on the mandrel 132 and cooperatively receives the mandrel axially and slidingly therein may be clearly seen. In the representatively illustrated embodiment, the profile 158 includes radially inwardly extending projections 210. For convenience of illustration, the profiles 158, 160 have been rotated somewhat in FIG. 8.

Thus has been described a travel joint 100 which is economical to manufacture, install, service, and operate, which eliminates pockets and cavities wherein fluids, such as acid, may be trapped, which minimizes internal surfaces exposed to fluids therein, which is able to wipe such fluids from substantially all of one of such internal surfaces, which requires only two parts, upper case 130 and mandrel 132, to be made of corrosion resistant materials where such resistance is desired for protection from corrosive fluids flowing therethrough, which requires only one dynamic seal and no static seals, which does not require utilization of hexagonal packing, which does not have excessive length, which includes no service breaks or threaded connections which are tightened or untightened when torque is transmitted through the travel joint, which does not have multiple threaded connections which must be disconnected for service thereof, which includes only one minimum internal diameter part, and which does not have abrupt internal shoulders and flow restrictions.

The foregoing detailed description is to be clearly understood as being given by way of illustration and example only, the spirit and scope of the present invention being limited solely by the appended claims.

What is claimed is:

1. An axially telescoping and generally tubular tool for use in a subterranean well wherein a torque is to be applied to the tool, the tool comprising:

an elongated tubular housing having opposite ends, a first one of the housing opposite ends having a circumferentially spaced apart series of axially extending first projections formed thereon;

an elongated tubular first member axially and telescopingly received in the housing; and an elongated tubular second member having opposite ends, one of the second member opposite ends having a circumferentially spaced apart series of axially extending second projections formed thereon, the second projections being complementarily shaped relative to the first projections, and the second projections cooperatively circumferentially engaging the first projections, whereby the torque may be transmitted from the housing to the second member by the cooperative engagement of the first and second projections.

2. The tool according to claim 1, wherein the first member further has a first profile externally formed thereon, and wherein the second member further has a second profile internally formed thereon, the second profile being complementarily shaped to axially slidably receive the first profile therein, and cooperative engagement of the first profile with the second profile permitting torque to be transmitted from the second member to the first member.

3. The tool according to claim 1, further comprising an elongated tubular third member coupled to the first housing opposite end and at least partially radially outwardly overlying the second member, and wherein the second member further comprises at least two circumferentially divided portions, the portions being radially inwardly retained in axially sliding engagement with the first member by the third member, and the portions being axially retained in cooperative engagement with the housing by the third member.

4. The tool according to claim 1, wherein the second member comprises at least two circumferentially divided portions, each of the portions having a generally axially extending edge formed thereon, each of the edges being complementarily shaped relative to another of the edges, and each of the edges having a section thereof which extends at least partially circumferentially.

5. The tool according to claim 1, wherein the first member is received in an inner bore of the housing, and further comprising a circumferential seal carried on the first member and sealingly engaging the inner bore, the seal traversing substantially all of the inner bore when the first member is axially and telescopingly displaced in the housing.

6. A travel joint for use in a subterranean well, the travel joint comprising:

a generally tubular housing having opposite ends;

a generally tubular torque collar releasably attached to the housing and extending axially outwardly therefrom, the torque collar having an inner side surface and a first axially extending profile formed on the inner side surface; and a generally tubular mandrel axially and slidably received in the torque collar, the mandrel having an outer side surface and a second axially extending profile formed on the outer side surface, the second profile being complementarily shaped relative to the first profile, and the second profile cooperatively engaging the first profile, such that the mandrel is restricted from rotational displacement relative to the torque collar and is permitted to displace axially relative to the torque collar.

7. The travel joint according to claim 6, wherein the second profile comprises a radially extending first face and a tangentially extending second face.

8. The travel joint according to claim 6, wherein the second profile consists of two axially extending faces, one of the faces extending radially relative to the mandrel, and the other of the faces extending in a tangential direction relative to the mandrel outer side surface.

9. The travel joint according to claim 6, wherein one of the housing opposite ends has a series of circumferentially spaced apart and axially extending first projections formed thereon, and wherein the torque collar further has a series of circumferentially spaced apart and axially extending second projections formed thereon, the first projections being complementarily shaped relative to the second projections, and the first projections cooperatively engaging the second projections when the torque collar is operatively attached to the housing.

10. The travel joint according to claim 6, wherein the torque collar comprises a plurality of circumferential portions, and further comprising a generally tubular adapter releasably attaching the torque collar to the housing, the adapter further radially retaining the first profile in cooperative engagement with the second profile.

11. Apparatus for use in a subterranean well, the apparatus comprising:

a tubular first member having opposite ends, one of the first member opposite ends having a circumferentially disposed first configuration formed thereon;

a tubular second member telescopingly received in the first member and having a portion thereof extending axially outwardly from the one of the first member opposite ends;

a tubular third member axially and slidingly disposed on the second member portion, the third member having an outer side surface and opposite ends, one of the third member opposite ends having a circumferentially disposed second configuration formed thereon, the second configuration being complementarily shaped relative to the first configuration; and a tubular fourth member having opposite ends and being radially outwardly disposed relative to the third member outer side surface, one of the fourth member opposite ends being attached to the one of the first member opposite ends, the fourth member radially inwardly retaining the third member, and the fourth member axially retaining the first configuration in cooperative engagement with the second configuration.

12. The apparatus according to claim 11, wherein the first configuration comprises a series of circumferentially spaced apart and axially extending first projections formed on the one of the first member opposite ends.

13. The apparatus according to claim 11, wherein the second member further has an axially extending notch formed on the portion, and wherein the third member further has a radially inwardly extending projection formed in an inner side surface thereof, the projection cooperatively engaging the notch to thereby prevent axial rotation of the second member relative to the third member.

14. The apparatus according to claim 11, wherein the third member is axially split into a series of circumferentially aligned portions, each of the third member portions being radially inwardly retained by the fourth member.

15. The apparatus according to claim 14, wherein each of the third member portions is axially retained relative to the others of the third member portions by complementary engagement of each of the third member portions with another one of the third member portions.

16. In a subterranean well having an elongated tool string axially disposed therein, a tool for transmitting torque within the tool string, the tool comprising:

a tubular mandrel having an axially extending outer side surface formed thereon, the mandrel being couplable to the tool string; and a collar axially slidably disposed on the mandrel and circumscribing an axial portion of the mandrel outer side surface, the collar having an inner side surface axially slidably engaging the mandrel outer side surface, and the collar inner side surface cooperatively engaging the mandrel outer side surface such that the collar is prevented from rotating on the mandrel, the collar further being circumferentially divided by an axially extending parting line, the parting line permitting the collar to be radially outwardly expanded relative to the mandrel outer side surface, and the parting line having a portion thereof which extends at least partially circumferentially about the collar, such that when the collar is operatively disposed on the mandrel the parting line portion axially aligns the collar on opposite sides of the parting line.

17. The tool according to claim 16, wherein the mandrel outer side surface has a first axially extending profile formed thereon, and wherein the collar inner side surface has a second axially extending profile formed thereon, the second profile being complementarily shaped relative to the first profile, such that the first profile cooperatively engages the second profile to prevent the collar from rotating on the mandrel when the collar is operatively disposed on the mandrel.

18. The tool according to claim 16, further comprising a tubular case having opposite ends, one of the opposite ends being couplable to the tool string, and the other of the opposite ends receiving the mandrel therein, being complementarily shaped relative to the collar, and axially engaging the collar to thereby prevent rotational displacement therebetween.

19. The tool according to claim 16, further comprising a tubular retainer radially outwardly disposed relative to the collar, the retainer preventing radially outward expansion of the collar relative to the mandrel outer side surface.

20. The tool according to claim 16, further comprising:

a tubular outer housing radially outwardly disposed relative to the mandrel, the outer housing having an axially extending inner side surface, and the mandrel being axially slidably received in the outer housing; and a seal carried on the mandrel, the seal being capable of wiping substantially all of the outer housing inner side surface when the mandrel is axially displaced relative to the outer housing.

21. An axially compressible joint for use in a tool string within a subterranean well, the joint comprising:

a tubular outer housing having an axially extending bore formed therethrough and opposite ends;

a tubular inner housing telescopingly received in the outer housing bore, the inner housing having a radially enlarged portion and a radially reduced portion, the radially enlarged portion axially slidingly engaging the outer housing bore, and the radially reduced portion extending axially outwardly from one of the outer housing opposite ends;

a seal disposed on the inner housing radially enlarged portion, the seal sealingly engaging the radially enlarged portion, and the seal sealingly and slidingly engaging the outer housing bore; and a tubular collar axially slidingly disposed on the inner housing radially reduced portion, the collar being coupled to the outer housing, and the collar having a radially extending fluid passage formed thereon, the outer housing, inner housing, and collar defining an annular chamber having a variable volume therebetween, the annular chamber being disposed radially intermediate the outer housing bore and the inner housing radially reduced portion, the annular chamber being disposed axially intermediate the inner housing radially enlarged portion and the collar, and the annular chamber being in fluid communication with the collar fluid passage.

22. The joint according to claim 21, wherein the inner housing radially reduced portion has an axially extending first profile formed thereon, and wherein the collar further has an inner side surface and an axially extending second profile formed thereon, the first and second profiles being complementarily shaped, and the first and second profiles cooperatively engaging each other to prevent rotation of the inner housing relative to the collar.

23. The joint according to claim 21, wherein an end portion of the collar complementarily engages the one of the housing end portions when the collar is coupled to the outer housing, the complementary engagement between the collar and the one of the housing end portions preventing axial rotation of one of them relative to the other one of them.

24. The joint according to claim 21, wherein the collar comprises more than one axially extending portions, and further comprising a tubular member radially outwardly overlying the collar portions.

25. The joint according to claim 24, wherein each of the axially extending portions complementarily engages an edge of a circumferentially adjacent other one of the axially extending portions, each of the edges having a section thereof which extends at least partially circumferentially.

26. A travel joint operatively positionable within a tool string in a subterranean wellbore, the tool string having first and second portions thereof, the travel joint comprising:

a tubular outer housing having an axially extending inner side surface defining an axial flow passage of the outer housing, the outer housing being directly couplable to the tubing string first portion, and the outer housing being impervious to fluid flow radially therethrough;

a tubular mandrel having first and second axial portions, the mandrel first axial portion being axially slidably received in the flow passage, the mandrel second axial portion extending axially outwardly from the outer housing and being directly couplable to the tool string second portion, and the mandrel being axially reciprocable within the outer housing bore; and a seal carried on the mandrel first axial portion and radially outwardly engaging the outer housing flow passage, the seal being capable of traversing substantially all of the outer housing flow passage when the mandrel is axially reciprocated within the outer housing flow passage.

27. The travel joint according to claim 26, further comprising a tubular collar radially outwardly and axially slidably disposed on the mandrel second axial portion, the collar further being rotationally interconnected with the outer housing by complementary axial engagement therewith.

28. A travel joint operatively positionable within a tool string in a subterranean wellbore, the tool string having first and second portions thereof, the travel joint comprising:

a tubular outer housing having an axially extending inner side surface defining an axial flow passage of the outer housing, the outer housing being directly countable to the tubing string first portion;

a tubular mandrel having first and second axial portions, the mandrel first axial portion being axially slidably received in the flow passage, the mandrel second axial portion extending axially outwardly from the outer housing and being directly couplable to the tool string second portion, and the mandrel being axially reciprocable within the outer housing flow passage;

a seal carried on the mandrel first axial portion and radially outwardly engaging the outer housing flow passage, the seal being capable of traversing substantially all of the outer housing flow passage when the mandrel is axially reciprocated within the outer housing flow passage; and a tubular collar radially outwardly and axially slidably disposed on the mandrel second axial portion, the collar having an inner profile formed thereon, and wherein the mandrel second axial portion further has an outer profile formed thereon, each of the inner and outer profiles being complementarily shaped relative to the other one of them, the inner profile cooperatively engaging the outer profile when the collar is disposed on the mandrel second axial portion.

29. A travel joint operatively positionable within a tool string in a subterranean wellbore, the tool string having first and second portions thereof, the travel joint comprising:

a tubular outer housing having an axially extending inner side surface defining an axial flow passage of the outer housing, the outer housing being directly couplable to the tubing string first portion;

a tubular mandrel having first and second axial portions, the mandrel first axial portion being axially slidably received in the flow passage, the mandrel second axial portion extending axially outwardly from the outer housing and being directly couplable to the tool string second portion, and the mandrel being axially reciprocable within the outer housing flow passage;

a seal carried on the mandrel first axial portion and radially outwardly engaging the outer housing flow passage, the seal being capable of traversing substantially all of the outer housing flow passage when the mandrel is axially reciprocated within the outer housing flow passage;

a tubular retainer coupled to the outer housing and extending axially outwardly therefrom, the retainer having a shoulder formed internally thereon; and a tubular torque transmitting member disposed axially intermediate the outer housing and the retainer shoulder, the torque member comprising a plurality of circumferential sections, and the torque member radially inwardly underlying the retainer, such that the torque member is axially and radially inwardly retained by the retainer.

30. A travel joint operatively positionable within a tool string in a subterranean wellbore, the tool string having first and second portions thereof, the travel joint comprising:

a tubular outer housing having an axially extending inner side surface defining an axial flow passage of the outer housing, the outer housing being directly couplable to the tubing string first portion;

a tubular mandrel having first and second axial portions, the mandrel first axial portion being axially slidably received in the flow passage, the mandrel second axial portion extending axially outwardly from the outer housing and being directly couplable to the tool string second portion, and the mandrel being axially reciprocable within the outer housing flow passage;

a seal carried on the mandrel first axial portion and radially outwardly engaging the outer housing flow passage, the seal being capable of traversing substantially all of the outer housing flow passage when the mandrel is axially reciprocated within the outer housing flow passage; and first and second axially extending and circumferentially spaced apart torque members radially outwardly overlying the mandrel second axial portion, the first and second torque members being capable of transmitting torque from the outer housing to the tubular mandrel, and the first and second torque members further being axially retained relative to each other by complementary circumferential engagement therebetween.

31. Apparatus operatively positionable in a subterranean well, comprising:

a housing having opposite ends;

a torque member releasably attached to the housing, the torque member having an inner side surface and a first axially extending profile formed on the inner side surface; and a mandrel reciprocably received in the torque member, the mandrel having an outer side surface and a second axially extending profile formed on the outer side surface, the second profile being complementarily shaped relative to the first profile, and the second profile cooperatively engaging the first profile.

32. Apparatus for use in a subterranean well, the apparatus comprising:

a first member having opposite ends, one of the first member opposite ends having a circumferentially extending first configuration formed thereon;

a second member telescopingly received in the first member and having a portion thereof extending axially outwardly from the one of the first member opposite ends;

a third member axially and slidingly disposed on the second member portion, the third member having an outer side surface and opposite ends, one of the third member opposite ends having a circumferentially disposed second configuration formed thereon, the second configuration being complementarily shaped relative to the first configuration; and a fourth member having opposite ends and being radially outwardly disposed relative to the third member outer side surface, one of the fourth member opposite ends being attached to the one of the first member opposite ends, and the fourth member radially inwardly retaining the third member.

33. Apparatus operatively positionable within a subterranean well, comprising:

a mandrel having an outer side surface; and a collar axially slidably disposed on the mandrel, the collar having an inner side surface cooperatively engaging the mandrel outer side surface such that the collar is prevented from rotating on the mandrel, the collar being circumferentially divided by an axially extending parting line, the parting line permitting the collar to be radially outwardly expanded relative to the mandrel outer side surface, and the parting line having a profile formed thereon, the profile axially aligning the collar on opposite sides of the parting line.

* * * * *